US007017549B2

(12) United States Patent
Doelker

(10) Patent No.: US 7,017,549 B2
(45) Date of Patent: Mar. 28, 2006

(54) PROCESS FOR CONTROLLING A COMBUSTION ENGINE

(75) Inventor: Armin Doelker, Immenstaad (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 36 days.

(21) Appl. No.: 10/883,975

(22) Filed: Jul. 6, 2004

(65) Prior Publication Data

US 2005/0051137 A1 Mar. 10, 2005

(30) Foreign Application Priority Data

Jul. 5, 2003 (DE) ..... 103 30 466

(51) Int. Cl.
*F02D 9/00* (2006.01)

(52) U.S. Cl. ..... 123/399; 701/102

(58) Field of Classification Search ..... 123/352, 123/357, 361, 396, 399; 701/102
See application file for complete search history.

(56) References Cited

U.S. PATENT DOCUMENTS 6,055,960 A * 5/2000 Marumoto et al. ..... 123/399
6,253,733 B1 * 7/2001 Marumoto et al. ..... 123/399
6,390,064 B1 * 5/2002 Marumoto et al. ..... 123/399
6,636,783 B1 * 10/2003 Yasui et al. ..... 700/282
6,718,254 B1 * 4/2004 Hashimoto et al. ..... 701/110

FOREIGN PATENT DOCUMENTS

DE 4020654 1/1992

* cited by examiner

*Primary Examiner*—Thomas Moulis
(74) *Attorney, Agent, or Firm*—Crowell & Moring LLP

(57) ABSTRACT

Proposed is a method for controlling an internal combustion engine (1) with a common-rail injection system and a high-pressure control loop. In this method, a pump with an intake throttle (3) is controlled by means of an electronic control device (4) using a PWM signal with a first frequency. The invention provides that a critical speed is calculated from the angular distance between injections and the first frequency of the PWM signal. A speed range is then determined as a function of the critical speed. For engine speed values that fall outside this speed range, the PWM signal is set to the first frequency. For engine speed values that fall within the speed range, the PWM signal is set to a second frequency. Switching the PWM signal reduces the pressure oscillations in the rail (6).

10 Claims, 7 Drawing Sheets

PROCESS FOR CONTROLLING A COMBUSTION ENGINE

This application claims the priority of German patent application DE 103 30 466.5, filed Jul. 5, 2003, the disclosure of which is expressly incorporated by reference herein.

The invention relates to a method for controlling an internal combustion engine with a common-rail injection system.

In an internal combustion engine with a common-rail injection system, a high-pressure pump delivers the fuel from a fuel tank to a high-pressure accumulator. This high-pressure accumulator is hereinafter referred as rail. The flow rate of the high-pressure pump is determined by an intake throttle, whose position is in turn defined by an electronic control device as a function of input variables, e.g., the desired performance. Typically, the control of the intake throttle is configured as a PWM (Pulse Width Modulated) signal with a constant frequency, e.g., 100 Hz. Thus, a periodic signal is injected into the rail as a result of this type of fuel delivery. The signal frequency corresponds to the frequency of the PWM signal. Fuel is periodically removed from the rail, such that the periodically fluctuating high fuel pressure is sampled. If the fuel is removed, e.g., at a frequency of 99 Hz, a differential signal of 1 Hz is created. This means that a 1 Hz signal is superimposed on the high fuel pressure.

If the speed of the internal combustion engine is slowly increased, a rising symmetrical high-pressure signal is generated within the range of certain engine speed values. These certain engine speed values are hereinafter referred to as critical speeds. The high fuel pressure oscillations become visible only when the damping of the rail is no longer sufficient, i.e., at frequencies of 0 to approximately 2 Hz. These pressure oscillations occur whenever the injection period becomes identical with the PWM frequency. In a 16-cylinder internal combustion engine, the injection period is 45 degrees relative to the crankshaft, i.e., the crankshaft passes through this angle between a first and a second injection. At the speed of 750 revolutions per minute, this angle corresponds to a frequency of 100 Hz. If the PWM frequency is also 100 Hz, then the periodically generated high-pressure signal flips at this critical speed. Below and above this critical speed, the pressure oscillations decrease again. The same applies to integral multiples of this speed value. These pressure oscillations in the rail are problematic, because, as a result, a consistent quality of the injection can no longer be guaranteed.

German patent specification DE 40 20 654 C2 discloses a control method for a PWM controlled actuator. In this method, the trailing edge of the PWM signal is modified as a function of a desired value. This is to enable the system to respond to a rapidly changing desired value, e.g., the accelerator pedal value. From the same source it is also known to change the periods of the PWM signal as a function of the desired value. This control method does not, however, mitigate the above-described problem of induced oscillations.

Thus, an the object of the invention is to reduce the pressure oscillations in the rail as a result of external excitation.

According to this invention, a critical speed is calculated from the angular distance between two injections, which defines the injection period, and the first frequency of the PWM signal (fundamental frequency). A speed range is then determined as a function of the critical speed. For engine speed values that fall within the speed range, the PWM signal is set to a second frequency. For engine speed values that fall outside the speed range, the PWM signal is set to the first frequency. In other words, in the range of the critical speed, the PWM signal is switched from the first to the second frequency. A separate speed range each is provided for an increasing engine speed and for a decreasing engine speed. Further, the frequency switching may occurs at an integral multiple of the critical speed.

Switching the PWM signal in the range of the critical speeds stabilizes the high-pressure control loop. An additional optimization of the high-pressure control parameters is not required, however. The P-, I- and D-components of the high-pressure controller remain unchanged. The effects on the hysteresis of the intake throttle are minor if the difference between the first and second frequencies is only minor, e.g., if the first frequency is 100 Hz and the second frequency is 120 Hz. Since the time constants of the controlled system, i.e., the pump with the intake throttle and the rail, are generally clearly larger than the reciprocal value of the first and the second frequency of the PWM signal, switching to the second frequency of the PWM signal is nearly interference-free. Thus, the effects on the high fuel pressure are minimal. In quite general terms, the invention offers the advantage that it can be integrated afterwards into an electronic control device of an internal combustion engine by simple means and at low cost.

Other objects, advantages and novel features of the present invention will become apparent from the following detailed description of the invention when considered in conjunction with the accompanying drawings.

DETAILED DESCRIPTION OF THE DRAWINGS

Figure 1:
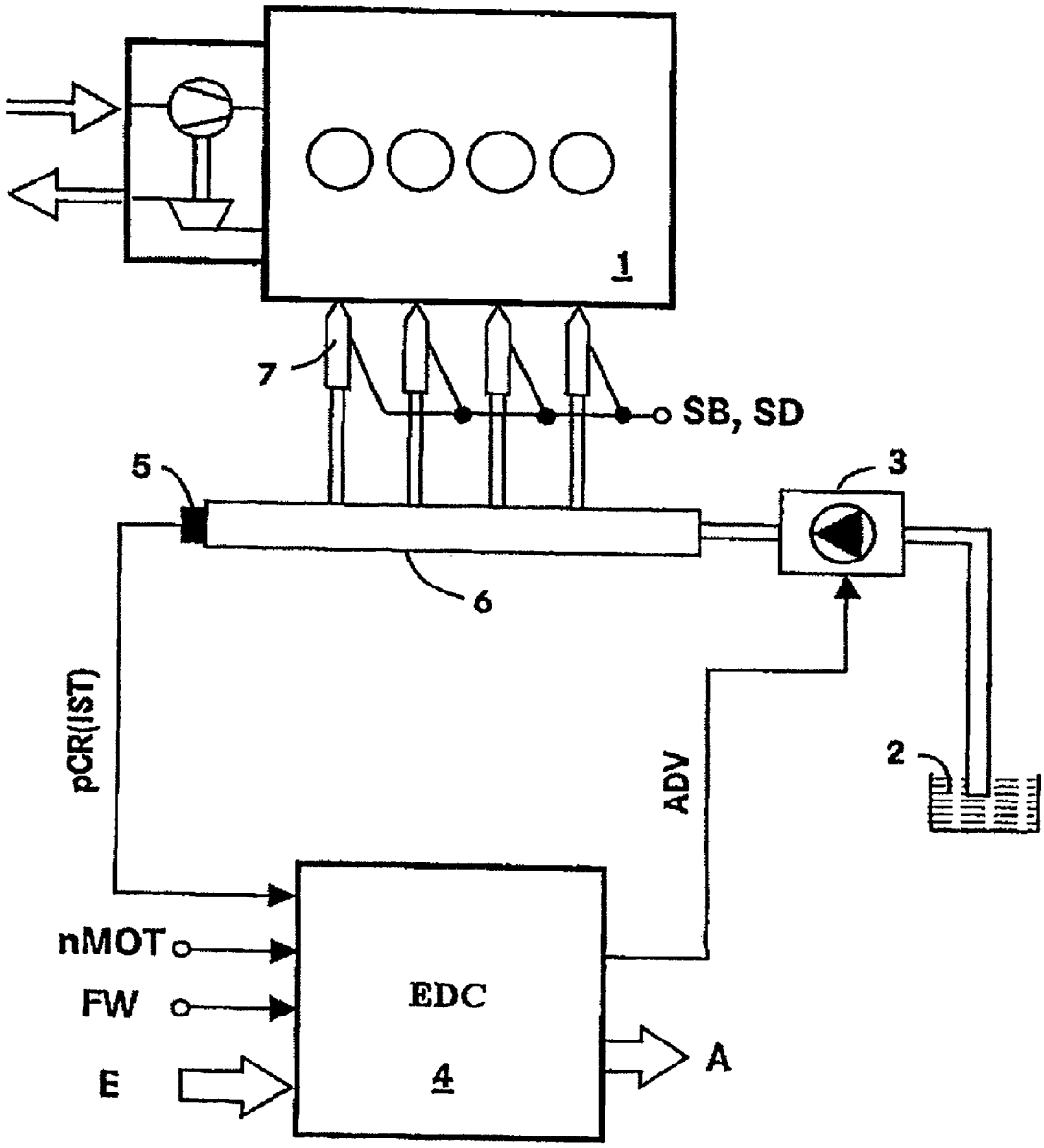
FIG. 1 is a system diagram.

FIG. 1 shows an internal combustion engine 1. In the depicted internal combustion engine 1, the fuel is injected via a common-rail system. This system has the following components: pumps 3 with an intake throttle for delivering the fuel from a fuel tank 2, a rail 6 for storing the fuel and injectors 7 for injecting the fuel from the rail 6 into the combustion chambers of the internal combustion engine 1.

The mode of operation of the internal combustion engine 1 is controlled by an electronic control device (EDC) 4. The electronic control device 4 has the conventional components of a microcomputer system, e.g., a microprocessor, I/O components, buffers and memory components (EEPROM, RAM). The operating data relevant for the operation of the internal combustion engine 1 are stored in the memory components as maps/characteristics, which the electronic control device 4 uses to calculate the output quantities from the input parameters. FIG. 1 shows the following input parameters by way of example: an actual rail pressure pCR(IST) measured by a rail pressure sensor 5, a speed signal nMOT of the internal combustion engine 1, an input variable E and a signal FW to input the power requirement by the operator. The input variable E subsumes, for example, the charge air pressure of a turbocharger, the temperatures of the coolant/lubricant and the fuel.

The output variables of the electronic control device 4 shown in FIG. 1 are a signal ADV to control the intake throttle and an output variable A. The output variable A represents the additional actuating signals to control and regulate the internal combustion engine 1, e.g., the start of injection SB and the duration of injection SD. In practice, the signal ADV is a pulse width modulated (PWM) signal.

Figure 2:
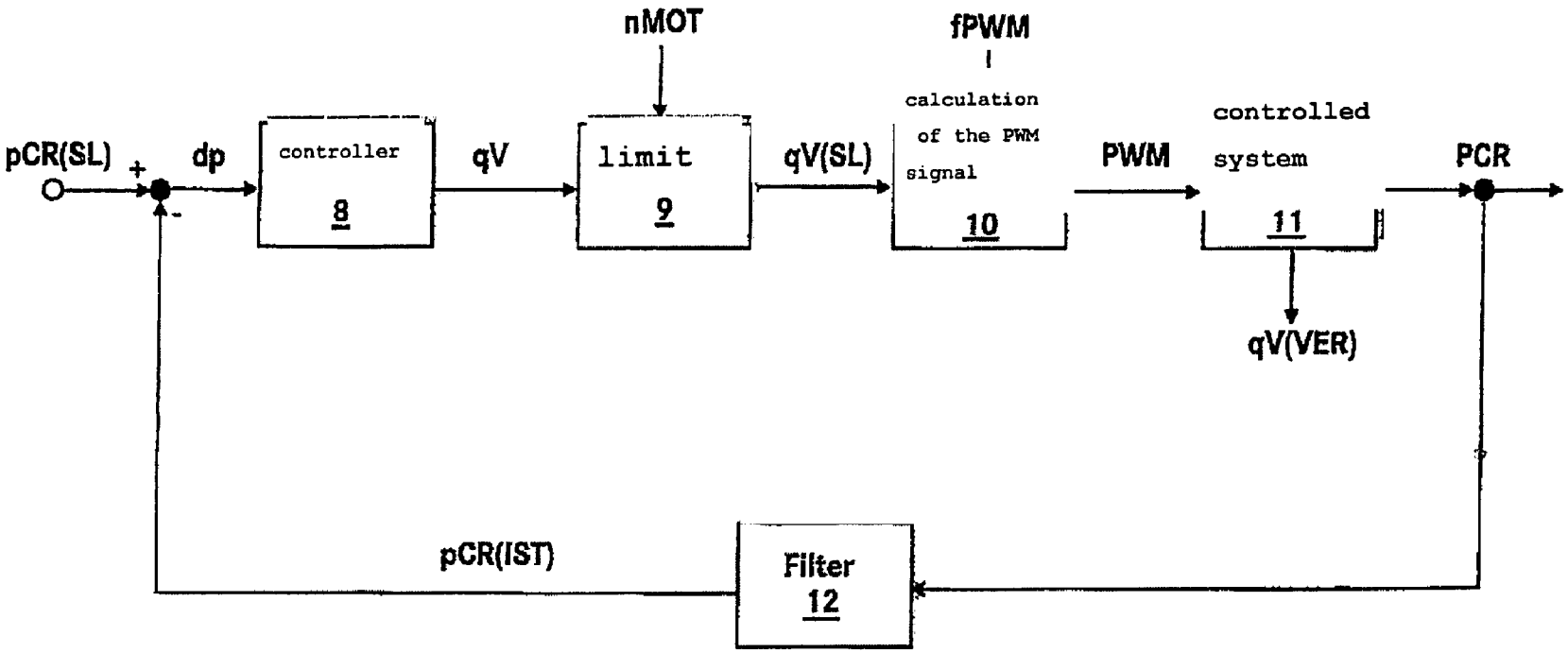
FIG. 2 illustrates a high-pressure control loop.

FIG. 2 shows a high-pressure control loop. The input variable corresponds to the desired value of the rail pressure pCR(SL). The output variable corresponds to the non-linearized value of the rail pressure pCR. From the non-linearized value of the rail pressure pCR, the actual rail pressure value pCR(IST) is determined by means of a filter 12. This value is compared with the desired value pCR(SL) at a summation point, resulting in the control deviation dp. From the control deviation dp an actuating variable is calculated using a high-pressure controller 8. The actuating variable corresponds to a volume flow rate qV. The physical unit of the volume flow rate is, for example, liters/minute. Optionally, the invention provides that the calculated target consumption is added to the volume flow rate qV. The volume flow rate qV corresponds to the input variable for a limit 9. The limit 9 can be configured as a function of the speed, the input variable nMOT. The output variable qV(SL) of the limit 9 is then converted in a function block 10 into a PWM signal. The conversion takes into account fluctuations of the operating voltage and the initial fuel pressure. The PWM signal is then applied to the solenoid of the intake throttle. This changes the displacement of the magnetic core, such that the flow rate of the high-pressure pump is freely influenced. The pumps 3 with the intake throttle and the rail 6 correspond to the control system 11. A volume flow rate qV(VER) is discharged from the rail 6 via the injectors 7. This closes the control loop.

Figure 3:
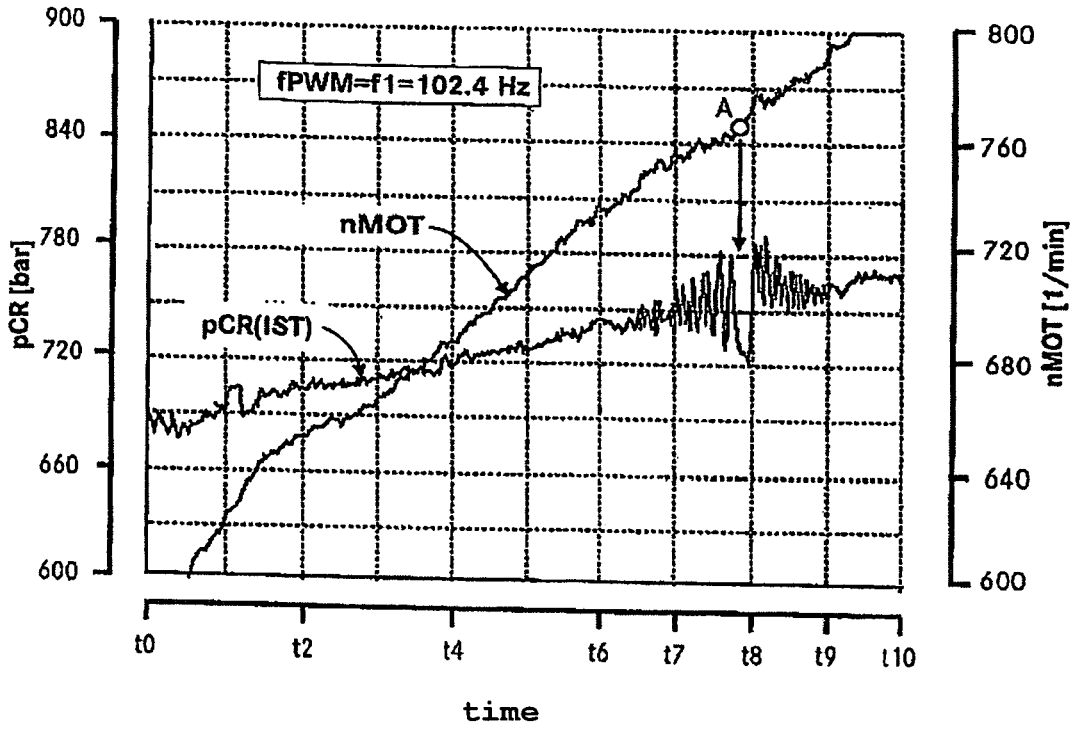
FIG. 3 is a time diagram.

FIG. 3 shows a time diagram for an acceleration of an internal combustion engine with sixteen cylinders. Here, the injection period is 45 degrees relative to the crankshaft. This time diagram is based on a PWM signal with a first frequency f1 of 102.4 Hz. The values of the rail pressure pCR and the values of the engine speed nMOT are plotted on the ordinates. The various time values are shown on the abscissa. The diagram itself shows the actual rail pressure pCR(IST) and the engine speed nMOT. The angular distance between two injections, the injection period, is a function of the number of the cylinders of the internal combustion engine. For a 20-cylinder engine, the angular distance can be, for example, 72 degrees.

Between the instants t7 and t8 the engine speed nMOT exceeds the speed value of 768 revolutions/minute at point A. This speed value corresponds to an injection frequency of 102.4 Hz. This frequency, in turn, is identical with the first frequency of the PWM signal. The actual rail pressure value pCR(IST) exhibits clear pressure oscillations with increasing amplitude starting with instant t6. The maximum amplitude (peak-to-peak) is approximately 40 bar. After the instant t8 the amplitude is reduced again.

The diagram of FIG. 3 illustrates that when the engine speed nMOT increases, a rising symmetrical high-pressure signal is formed in the range of the critical speed, in this case 768 revolutions/minute. The oscillations of the actual rail pressure value pCR(IST) become visible when the damping of the rail is no longer sufficient, i.e., at frequencies of 0 to approximately 2 Hz. The rail dampens frequencies higher than 2 Hz to the point where they are hardly visible anymore. The pressure fluctuations of the actual rail pressure value pCR(IST) occur whenever the injection period is identical with the first frequency f1 of the PWM signal. This is also true for the integral multiples of the injection period. This results in additional critical speeds at multiples of 768 revolutions/minute, i.e., at 1536 and 2304 revolutions/minute.

Figure 4:
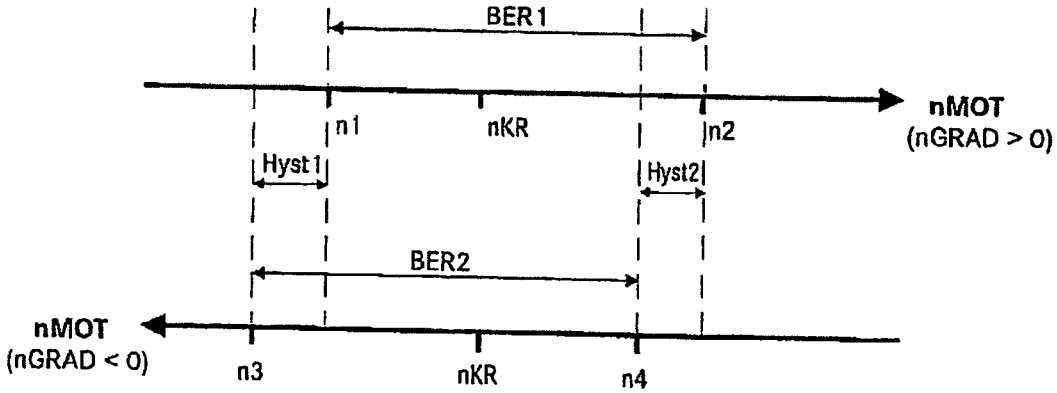
FIG. 4 is a speed diagram
FIG. 5A, B show two state diagrams.

FIG. 4 shows a speed diagram for an increasing engine speed (arrow pointing to the right) and a decreasing engine speed (arrow pointing to the left). An increasing or decreasing engine speed can, for example, be identified by means of the speed gradient nGRAD. The invention provides that a critical speed nKR be calculated from the injection period and the first frequency f1 of the PWM signal. The critical speed nKR corresponds, for example, to 768 revolutions/minute corresponding to point A of FIG. 3. A first speed range BER1 and a second speed range BER2 are then determined as a function of the critical speed nKR. These ranges can be, for example, 120 revolutions/minute. The first speed range BER1 is defined by a first limit value n1 and a second limit value n2. The second speed range BER2 is defined by a third limit value n3 and a fourth limit value n4. The first limit value n1 and the third limit value n3 are set to engine speed values smaller than the critical speed nKR. The second limit value n2 and the fourth limit value n4 are set to engine speed values higher than the critical speed nKR. With increasing engine speed nMOT the PWM signal is switched from the first frequency f1 to the second frequency f2 at the first limit value n1. With decreasing engine speed nMOT, switching back to the first frequency f1 below the critical speed nKR occurs only when the engine speed drops below the third limit value n3. The third limit value n3 is shifted relative to the first limit value n1 toward smaller engine speed values by a first hysteresis value Hyst1. The value of the first hysteresis Hyst1 can be, for example, 20 revolutions/minute. It prevents a switching back and forth between two frequencies in stationary operation.

Above the critical speed nKR, with increasing engine speed nMOT, the system switches from the second frequency f2 back to the first frequency f1 when the second limit value n2 is exceeded. With decreasing speed, switching back to the second frequency f2 occurs only when the speed drops below the fourth limit value n4. The fourth limit value n4 is shifted relative to the third limit value n3 toward smaller engine speed values by a second hysteresis value Hyst2. Overall, there are two speed ranges BER1 and BER2 within which the second frequency f2 is valid. Outside these speed ranges, the frequency of the PWM signal is identical with the first frequency f1. If the first frequency f1 is, for example, 102.4 Hz, the critical speed nKR is 768 revolutions/minute for an injection period of a 45-degree crank angle. For a second frequency f2 of 120 Hz, the resulting critical speed nKR would be 900 revolutions/minute. If the first limit value n1 is set to 700 revolutions/minute and the second limit value n2 to 820 revolutions/minute, no high-pressure oscillations can form.

Figure 5A:
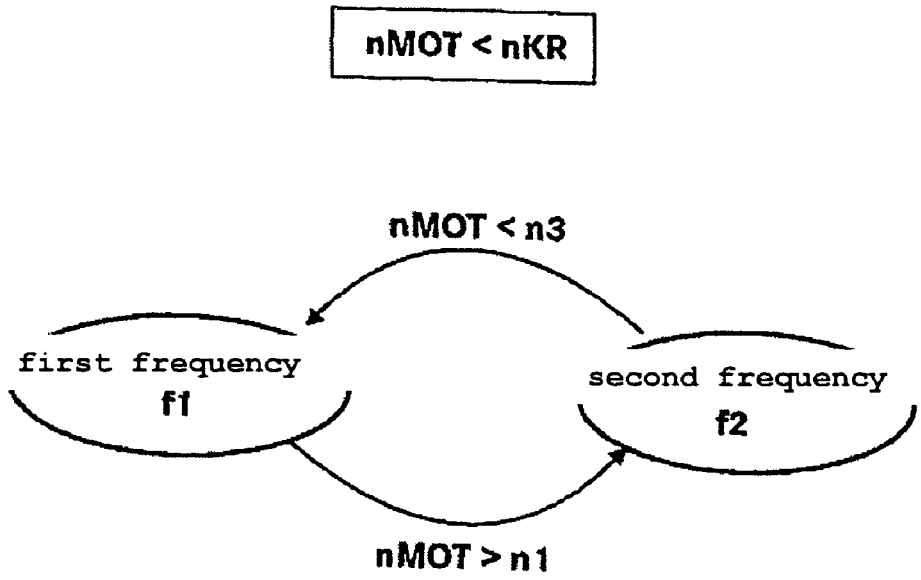
Figure 5B:
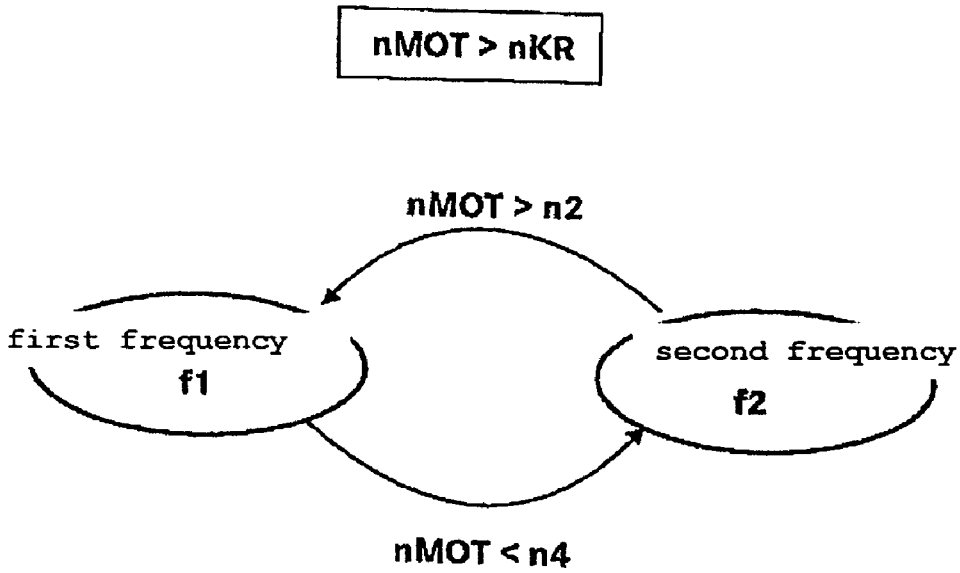

FIGS. 5A and 5B are state diagrams that again illustrate the switching mechanism from the first frequency f1 to the second frequency f2 and vice versa.

FIG. 5A shows that, for engine speeds nMOT below the critical speed nKR, the system switches from the first frequency f1 to the second frequency f2 when the engine speed nMOT becomes greater than the first limit value n1. It switches back to the first frequency f1 when the engine speed nMOT becomes smaller than the third limit value n3, which corresponds to the difference of the first limit value n1 minus the first hysteresis value Hyst1.

FIG. 5B shows that, for engine speeds nMOT above the critical speed nKR, the system switches from the second frequency f2 to the first frequency f1 when the engine speed nMOT exceeds the second limit value n2. It switches back to the second frequency f2 when the engine speed nMOT becomes smaller than the fourth limit value n4, which corresponds to the difference of the second limit value n2 minus the second hysteresis Hyst2.

Figure 6:
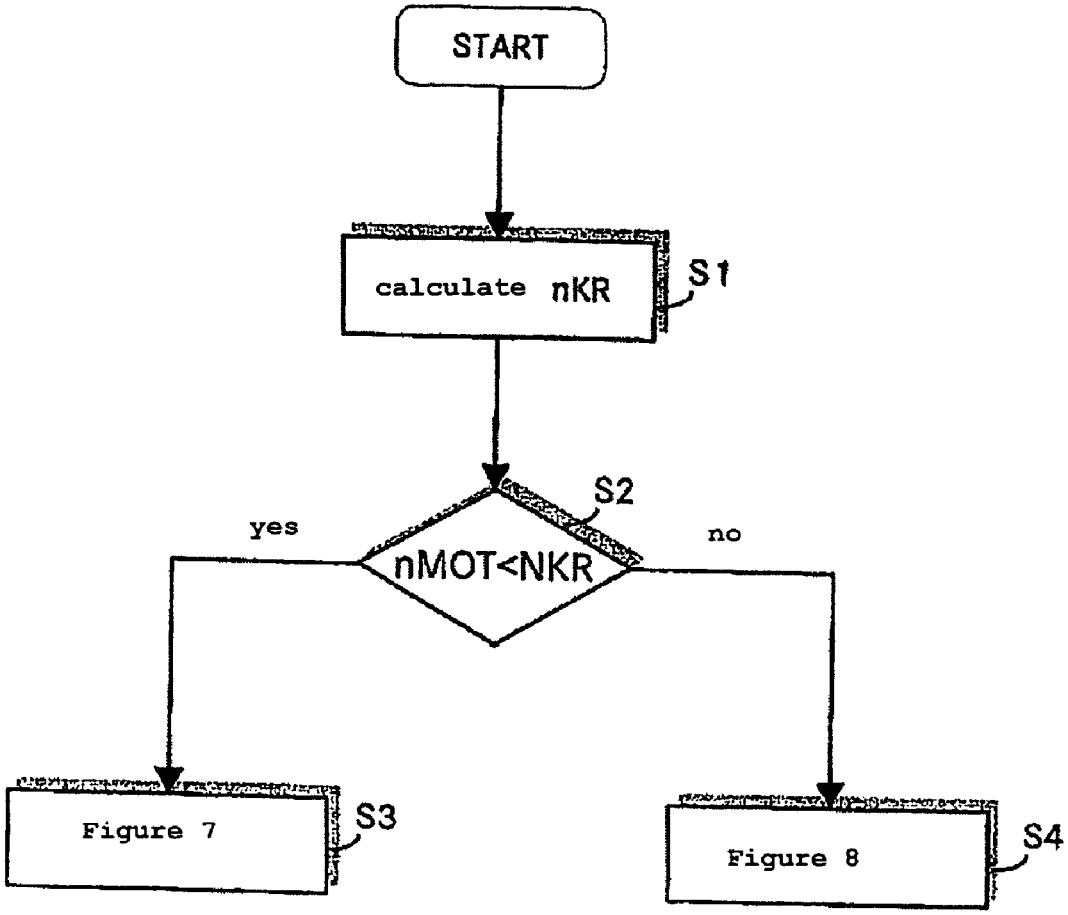
FIG. 6 is a program flowchart.

FIG. 6 shows a program flowchart. At S1 the critical speed nKR is calculated from the angular distance between two injections, i.e., the injection period, and the first frequency f1 of the PWM signal. At S2 the system checks whether the engine speed nMOT is smaller than the critical speed nKR.

Figure 7:
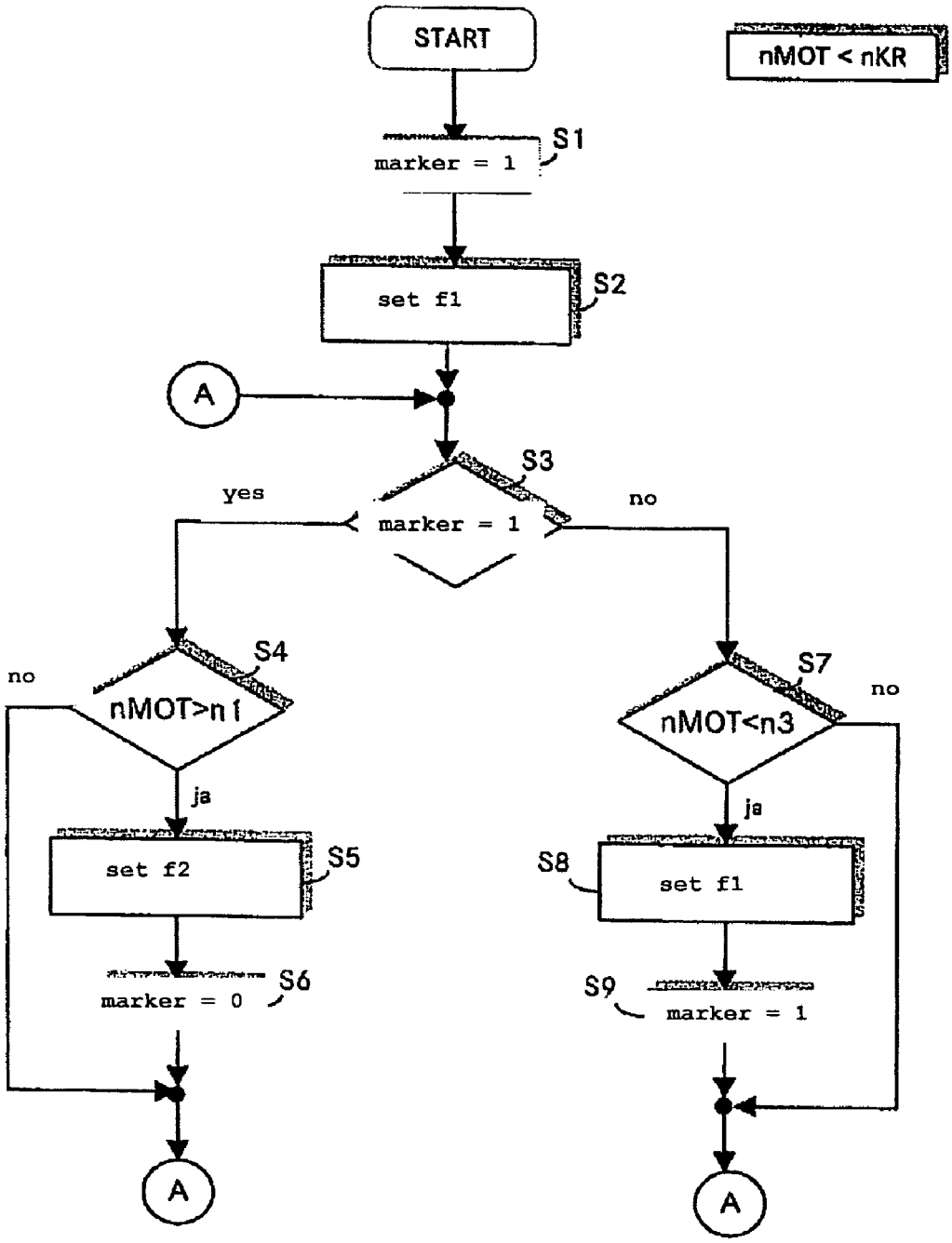
FIG. 7 is a program flowchart.

If it is smaller, the system goes to the program flowchart of FIG. 7 at S3. If it is greater it goes to the program flowchart of FIG. 8 at S4.

FIG. 7 is a program flowchart for engine speeds nMOT below the critical speed nKR. After the internal combustion engine is started up, a marker is set to one at S1. The PWM signal is then set to the first frequency f1, e.g., 102.4 Hz at S2. Thereafter, at S3, the system checks if the marker has the value one. If yes, it checks if the engine speed nMOT has exceeded the limit value n1 at S4. If yes, the frequency of the PWM signal is set to the second frequency f2 at step S5. Thus the PWM signal is switched. Subsequently, the marker is set to the value zero at S6 and the system goes to point A. If the query at S4 is answered negatively, the system goes directly to point A.

If the result of the check at S3 is that the marker has the value zero, the system checks at step S7 if the engine speed nMOT exceeds the third limit value n3, which corresponds to the difference of the first limit value n1 minus the first hysteresis Hyst1. If yes, the frequency of the PWM signal is set back to the value f1 at step S8. At step S9 the marker is then set back to the value one and the system goes to point A. If the query at S7 is answered negatively, the system goes directly to point A.

Figure 8:
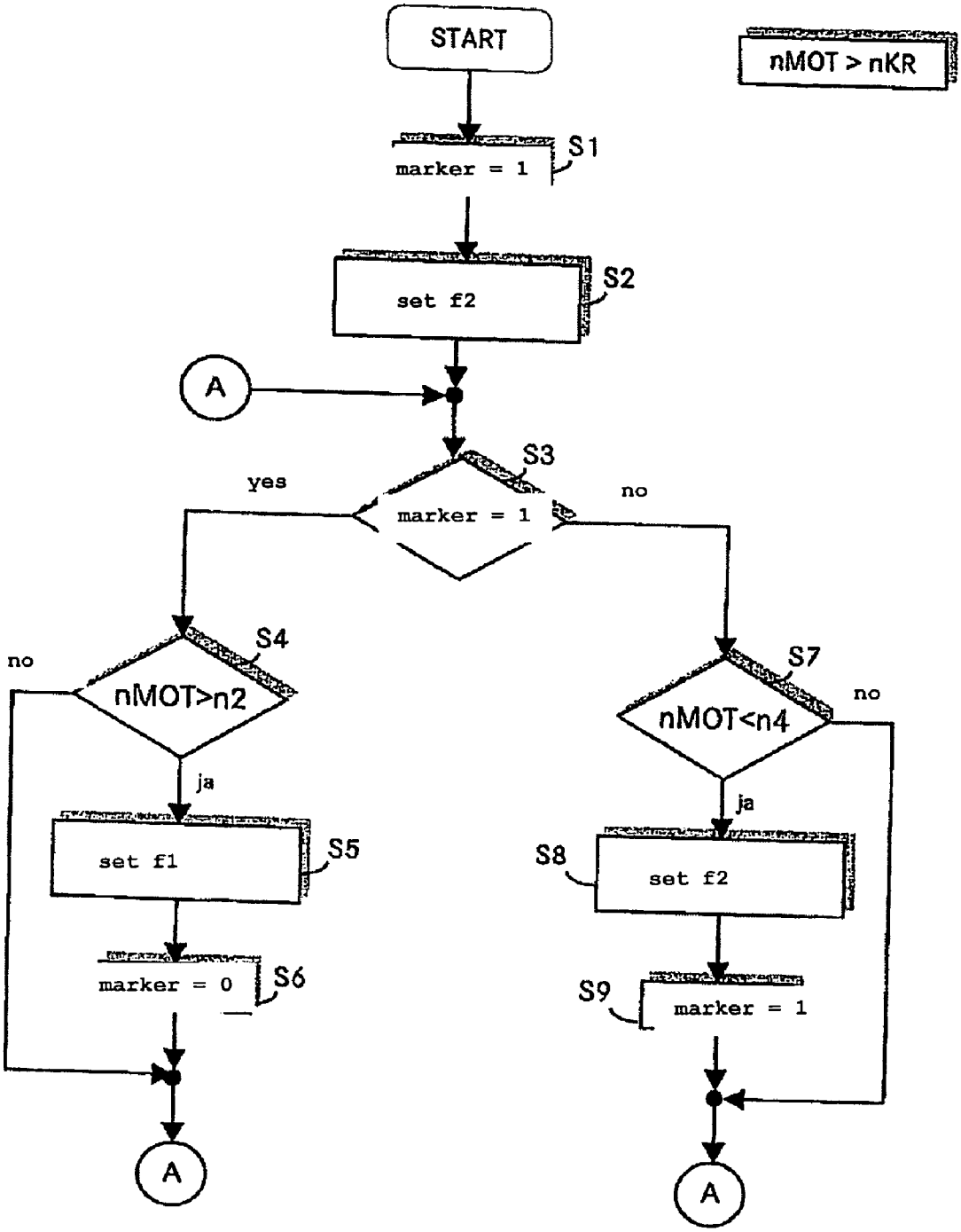
FIG. 8 is a program flowchart.

FIG. 8 shows a program flowchart for engine speeds nMOT above the critical speed nKR. First, a marker is set to the value one. At S2, the PWM signal is set to the second frequency f2. At S3 the system checks if the marker has the value one. If yes, it checks, at S4, if the engine speed nMOT exceeds the second limit value n2. If the result is positive, the PWM signal is set to the first frequency f1 and the marker is set to the value zero at S5 and S6. The system then goes to program point A. If the query at S4 is answered negatively, it goes directly to point A.

If the result of the check at S3 is that the marker has the value zero, the system checks at S7 if the engine speed nMOT is smaller than the fourth limit value n4, which corresponds to the difference of the second limit value n2 minus the second hysteresis Hyst2. If yes, the PWM signal is set to the second frequency f2 at S8 and the marker is set to the value one at S9. Thereafter the system goes back to program point A. If the query at S7 is answered negatively it goes directly to point A.

Based on the above description, the invention offers the following advantages:

Switching the frequency of the PWM signal prevents the occurrence of high-pressure oscillations in the rail.

Since the difference between the two frequency values of the PWM signal is minor, the effects on the hysteresis of the intake throttle are minor.

No further optimization of high-pressure control parameters is required to stabilize the high-pressure control loop in the critical speed ranges.

Since the time constants of the controlled system (pumps with intake throttle and rail) are generally substantially larger than the reciprocal value of the PWM frequency, switching from the first frequency to the second frequency and vice versa is nearly interference-free, i.e., it has no effect on the high fuel pressure.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A method of regulating an internal combustion engine having a common rail injection system, whereby a manipulated variable is calculated from an actual value and a setpoint value of the rail pressure by means of a high-pressure regulator and a PWM signal with a first frequency for triggering the controlled system is determined as a function of the manipulated variable, wherein a critical rotational speed is calculated from the angular distance of two injections and the first frequency of the PWM signal, a rotational speed range is defined as a function of the critical rotational speed and at engine rotational speed values outside of this rotational speed range, the PWM signal is set at the first frequency or in the case of engine rotational speed values within the rotational speed range, the PWM signal is set at a second frequency.

2. Method as recited in claim 1, wherein the rotational speed range corresponds to a first rotational speed range having a first limiting value and a second limiting value and the first rotational speed range is set at an increasing engine rotational speed.

3. Method as recited in claim 2, wherein the first limiting value is below the critical rotational speed and the second limiting value is above the critical rotational speed.

4. Method as recited in claim 3, wherein the PWM signal is switched from the first frequency to the second frequency when the engine rotational speed is greater than the first limiting value (n1) of the first range and is switched from the second frequency to the first frequency when the engine rotational speed is greater than the second limiting value of the first range.

5. Method as recited in claim 1, wherein the rotational speed range corresponds to a second rotational speed range having a third limiting value and a fourth limiting value and the second rotational speed range is set when the engine rotational speed is declining.

6. Method as recited in claim 2, wherein the second rotational speed range is shifted toward small engine rotational speed values by a hysteresis value in comparison with the first rotational speed range.

7. Method as recited in claim 2, wherein the third limiting value is calculated from the first limiting value minus a first hysteresis value and the fourth limiting value is calculated from the second limiting value minus a second hysteresis value.

8. Method as recited in claim 6, wherein the PWM signal is switched from the first frequency to the second frequency when the engine rotational speed is smaller than the first limiting value of the second range and is switched from the second frequency to the first frequency when the engine rotational speed is smaller than the third limiting value of the second range.

9. Method as recited in any one of claim 1, wherein the integral multiple of the critical rotational speed is calculated.

10. Method as recited in claim 9, wherein at the integral multiple of the critical rotational speed, the frequency of the PWM signal is switched according to claim 1.

* * * * *